US007109964B2

(12) United States Patent
Pai

(10) Patent No.: US 7,109,964 B2
(45) Date of Patent: Sep. 19, 2006

(54) METHOD FOR DRIVING AN LIQUID CRYSTAL DISPLAY IN A DYNAMIC INVERSION MANNER

(75) Inventor: Feng-Ting Pai, Hsinchu (TW)

(73) Assignee: Hannstar Display Corporation, Taipei (TW)

( * ) Notice: Subject to any disclaimer, the term of this patent is extended or adjusted under 35 U.S.C. 154(b) by 354 days.

(21) Appl. No.: 10/602,388

(22) Filed: Jun. 24, 2003

(65) Prior Publication Data

US 2004/0032386 A1 Feb. 19, 2004

(30) Foreign Application Priority Data

Aug. 16, 2002 (TW) ..... 91118631 A

(51) Int. Cl.
*G09G 3/36* (2006.01)

(52) U.S. Cl. ..... 345/96; 345/96; 345/103

(58) Field of Classification Search ..... 345/87–89, 345/94–101, 103, 208–210
See application file for complete search history.

(56) References Cited

U.S. PATENT DOCUMENTS 5,790,092 A * 8/1998 Moriyama ..... 345/96
6,222,596 B1 * 4/2001 Veerasamy ..... 349/50
6,396,468 B1 * 5/2002 Matsushima et al. ..... 345/87
6,400,350 B1 * 6/2002 Nishimura et al. ..... 345/96
6,469,684 B1 * 10/2002 Cole ..... 345/58
2001/0015716 A1 * 8/2001 Kim ..... 345/96
2002/0154085 A1 * 10/2002 Kim ..... 345/96
2003/0001812 A1 * 1/2003 Lee et al. ..... 345/94
2003/0107544 A1 * 6/2003 Edwards ..... 345/96

FOREIGN PATENT DOCUMENTS

TW 401529 10/1989

* cited by examiner

*Primary Examiner*—Xiao Wu
(74) *Attorney, Agent, or Firm*—Seyfarth Shaw LLP

(57) ABSTRACT

A driving method is used for driving a liquid crystal display in a dynamic inversion manner. First, a polarity frame is divided into a plurality of polarity blocks with the same area along scanning lines. By a DC balance requirement as the prerequisite, the polarities of one half of the pixels, total n, connected to the same signal line of one polarity block, are positive, and the polarities of other half of the pixels are negative. Polarity patterns, total 2n frames, are generated from sequentially shifting one polarity line to the next polarity line and shifting the bottom polarity line to the top polarity line in each polarity block. Polarity patterns are arranged in a polarity inversion group in a sequence. During a period of the polarity inversion group, each of the polarity patterns separately appears one time for inverting the polarities of the pixels to avoid a flicker image under the displaying of a specific test pattern.

10 Claims, 6 Drawing Sheets column

| row | 1 | 2 | 3 | 4 | ····· | |
|---|---|---|---|---|---|---|
| 1 | + | − | + | − | ··· | ··· |
| 2 | + | − | + | − | ··· | ··· |
| 3 | + | − | + | − | ··· | ··· |
| ⋮ | · | · | · | · | ··· | ··· |
| n | + | − | + | − | ··· | ··· |
| n+1 | − | + | − | + | ··· | ··· |
| n+2 | − | + | − | + | ··· | ··· |
| n+3 | − | + | − | + | ··· | ··· |
| ⋮ | · | · | · | · | ··· | ··· |
| 2n | − | + | − | + | ··· | ··· |

FIG. 5(a)

| | | | | | |
|---|---|---|---|---|---|
| + | − | + | − | ··· | ··· |
| + | − | + | − | ··· | ··· |
| · | · | · | · | ··· | ··· |
| + | − | + | − | ··· | ··· |
| − | + | − | + | ··· | ··· |
| − | + | − | + | ··· | ··· |
| − | + | − | + | ··· | ··· |
| · | · | · | · | ··· | ··· |
| − | + | − | + | ··· | ··· |
| + | − | + | − | ··· | ··· |

FIG. 5(b)

| | | | | | |
|---|---|---|---|---|---|
| + | − | + | − | ··· | ··· |
| · | · | · | · | ··· | ··· |
| + | − | + | − | ··· | ··· |
| − | + | − | + | ··· | ··· |
| − | + | − | + | ··· | ··· |
| − | + | − | + | ··· | ··· |
| · | · | · | · | ··· | ··· |
| − | + | − | + | ··· | ··· |
| + | − | + | − | ··· | ··· |
| + | − | + | − | ··· | ··· |

FIG. 5(c)

| | | | | | |
|---|---|---|---|---|---|
| · | · | · | · | ··· | ··· |
| + | − | + | − | ··· | ··· |
| − | + | − | + | ··· | ··· |
| − | + | − | + | ··· | ··· |
| − | + | − | + | ··· | ··· |
| · | · | · | · | ··· | ··· |
| − | + | − | + | ··· | ··· |
| + | − | + | − | ··· | ··· |
| + | − | + | − | ··· | ··· |
| + | − | + | − | ··· | ··· |

FIG. 5(d)

| | | | | | |
|---|---|---|---|---|---|
| − | + | − | + | ··· | ··· |
| + | − | + | − | ··· | ··· |
| + | − | + | − | ··· | ··· |
| + | − | + | − | ··· | ··· |
| · | · | · | · | ··· | ··· |
| + | − | + | − | ··· | ··· |
| − | + | − | + | ··· | ··· |
| − | + | − | + | ··· | ··· |
| − | + | − | + | ··· | ··· |
| · | · | · | · | ··· | ··· |

FIG 5(e)

column

| row | 1 | 2 | 3 | 4 | ····· | |
|---|---|---|---|---|---|---|
| 1 | + | − | + | − | ··· | ··· |
| 2 | + | − | + | − | ··· | ··· |
| 3 | − | + | − | + | ··· | ··· |
| 4 | − | + | − | + | ··· | ··· |

FIG. 6(a)

| | | | | | |
|---|---|---|---|---|---|
| + | − | + | − | ··· | ··· |
| − | + | − | + | ··· | ··· |
| − | + | − | + | ··· | ··· |
| + | − | + | − | ··· | ··· |

FIG. 6(b)

| | | | | | |
|---|---|---|---|---|---|
| − | + | − | + | ··· | ··· |
| − | + | − | + | ··· | ··· |
| + | − | + | − | ··· | ··· |
| + | − | + | − | ··· | ··· |

FIG. 6(c)

| | | | | | |
|---|---|---|---|---|---|
| − | + | − | + | ··· | ··· |
| + | − | + | − | ··· | ··· |
| + | − | + | − | ··· | ··· |
| − | + | − | + | ··· | ··· |

FIG. 6(d)

column

| row | 1 | 2 | 3 | 4 | ..... | |
|---|---|---|---|---|---|---|
| 1 | + | + | − | − | ... | ... |
| 2 | + | + | − | − | ... | ... |
| 3 | − | − | + | + | ... | ... |
| 4 | − | − | + | + | ... | ... |

FIG. 7(a)

| | | | | | |
|---|---|---|---|---|---|
| + | + | − | − | ... | ... |
| − | − | + | + | ... | ... |
| − | − | + | + | ... | ... |
| + | + | − | − | ... | .. |

FIG. 7(b)

| | | | | | |
|---|---|---|---|---|---|
| − | − | + | + | ... | ... |
| − | − | + | + | ... | ... |
| + | + | − | − | ... | ... |
| + | + | − | − | ... | ... |

FIG. 7(c)

| | | | | | |
|---|---|---|---|---|---|
| − | − | + | + | ... | ... |
| + | + | − | − | ... | ... |
| + | + | − | − | ... | ... |
| − | − | + | + | ... | ... |

FIG. 7(d)

column

| row | 1 | 2 | 3 | 4 | ····· | |
|---|---|---|---|---|---|---|
| 1 | + | − | + | − | ··· | ··· |
| 2 | + | − | + | − | ··· | ··· |
| 3 | + | − | + | − | ··· | ··· |
| 4 | − | + | − | + | ··· | ··· |
| 5 | − | + | − | + | ··· | ··· |
| 6 | − | + | − | + | ··· | ··· |

FIG. 8(a)

| | | | | | |
|---|---|---|---|---|---|
| + | − | + | − | ··· | ··· |
| + | − | + | − | ··· | ··· |
| − | + | − | + | ··· | ··· |
| − | + | − | + | ··· | ··· |
| − | + | − | + | ··· | ··· |
| + | − | + | − | ··· | ··· |

FIG. 8(b)

| | | | | | |
|---|---|---|---|---|---|
| + | − | + | − | ··· | ··· |
| − | + | − | + | ··· | ··· |
| − | + | − | + | ··· | ··· |
| − | + | − | + | ··· | ··· |
| + | − | + | − | ··· | ··· |
| + | − | + | − | ··· | ··· |

FIG. 8(c)

| | | | | | |
|---|---|---|---|---|---|
| − | + | − | + | ··· | ··· |
| − | + | − | + | ··· | ··· |
| − | + | − | + | ··· | ··· |
| + | − | + | − | ··· | ··· |
| + | − | + | − | ··· | ··· |
| + | − | + | − | ··· | ··· |

FIG. 8(d)

| | | | | | |
|---|---|---|---|---|---|
| − | + | − | + | ··· | ··· |
| − | + | − | + | ··· | ··· |
| + | − | + | − | ··· | ··· |
| + | − | + | − | ··· | ··· |
| + | − | + | − | ··· | ··· |
| − | + | − | + | ··· | ··· |

FIG. 8(e)

| | | | | | |
|---|---|---|---|---|---|
| − | + | − | + | ··· | ··· |
| + | − | + | − | ··· | ··· |
| + | − | + | − | ··· | ··· |
| + | − | + | − | ··· | ··· |
| − | + | − | + | ··· | ··· |
| − | + | − | + | ··· | ··· |

FIG. 8(f)

METHOD FOR DRIVING AN LIQUID CRYSTAL DISPLAY IN A DYNAMIC INVERSION MANNER

BACKGROUND OF THE INVENTION

1. Field of the Invention

The present invention relates to a method for driving a liquid crystal display (LCD), and more particularly to a method for driving an LCD panel employing a dynamic inversion manner.

2. Description of the Related Art

The image quality of LCDs deteriorates due to a flicker phenomenon, which is directly relative to the sensitivity of naked eyes. Thin film transistor LCDs (TFT-LCDs) and super twisted nematic LCDs (STN-LCDs) are now generally used for display apparatuses. Unfortunately, both of them also have flicker problems. In most cases to avoid flicker images, LCDs must be driven in an AC electrical field, because polarity inversion is needed. In LC cells, we find that flicker is mainly caused by the mobile ion charges. Even though a higher frequency AC applied to the LC cells can reduce the flicker phenomenon. But power consumption is dependent on the frequency of the AC electrical field. On the other hand, due to a stray capacitor effect, the center level of driving signals shifts between two consecutive frame periods, so the amplitudes of driving signals are different between the positive polarity and the negative polarity of the LC cells. Therefore, the flicker problem becomes worse.

Now, there are four driving methods of the polarity inversion, described as follows:

1. Frame Inversion

Driving signals are applied to LC cells in the LCD panel in such manner that each pixel of the whole frame has the same polarity during a frame period, as shown in FIG. 1(*a*). When the next frame period comes, the polarity of each pixel is inverted, as shown in FIG. 1(*b*).

2. Row Inversion

FIG. 2(*a*) Shows polarity patterns of driving signals applied to LC cells in the LCD panel using a row inversion. Driving signals are applied to LC cells in the LCD panel in such manner that each pixel in the same row line, e.g., a scanning line, has the same polarity, and each pixel in the adjacent row line has a polarity contrary to one in either the previous row line or the next row line during a frame period. When the next frame period comes, the polarity of each pixel is inverted, as shown in FIG. 2(*b*).

3. Column Inversion

FIG. 3(*a*) Shows polarity patterns of driving signals applied to LC cells in the LCD panel using a column inversion. Driving signals are applied to LC cells in the LCD panel in such manner that each pixel in the same column line, e.g., a signal line, has the same polarity, and each pixel in the adjacent column line has a polarity contrary to one in either the previous column line or the next column line during a frame period. When the next frame period comes, the polarity of each pixel is inverted, as shown in FIG. 3(*b*).

4. Dot Inversion

As shown in FIGS. 4(*a*) and 4(*b*), driving signals having polarities contrary to the adjacent LC cells on the row lines and to the adjacent LC cells on the column lines are applied to each LC cell in the LCD panel, and the polarities of driving signals applied to all LC cells in the LCD panel are inverted every frame period.

The aforementioned conventional driving methods of polarity inversion also have flicker problems during the displaying of a specific test pattern. For example, when an LCD panel using a dot inversion method shows sub-pixel test patterns, flickers are generated on the LCD panel. An LCD panel using a row inversion method has flicker defects during the displaying of a horizontal-line test pattern. In other words, all four driving methods will display flicker images under a specific test pattern. A user with sensitive vision is likely to detect the same problem.

Furthermore, Taiwan Patent No. 401,529 discloses a driving method and a driving circuit for a LCD. By adding more signal driving devices to the upper and lower areas of the LCD panel, the LCD panel can only have four polarity patterns, as shown in FIGS. 6(*a*)–7(*b*) of the specification. In this configuration of the LCD panel, more non-display space is needed and leads to an increase in manufacturing costs.

SUMMARY OF THE INVENTION

The first object of the present invention is to provide a driving method employing a dynamic inversion for effectively reducing the flicker phenomenon of an LCD panel under a specific test pattern.

The second object of the present invention is to provide a driving method to meet a DC balance requirement. The driving method can eliminate image residues to prevent a previous image overlapping the following image.

The third object of the present invention is to provide a polarity inversion group. The polarity inversion group comprises a plurality of polarity patterns in a sequence, and each of the polarity patterns invert the polarity of each pixel in the LCD panel during a period that all the polarity patterns appear. Employing the driving method instead of applying a higher frequency AC can effectively reduce the flicker phenomenon.

The fourth object of the present invention is to provide a driving method able to apply itself to an LCD panel. The driving method is compatible with a conventional driving circuit, and keeps the same packaging volume in an LCD panel.

In order to achieve these objects, the present invention discloses a method for driving a liquid crystal display in a dynamic inversion manner, which comprises steps (a) to (d). In step (a), a frame is divided into a plurality of polarity blocks, and each of the polarity blocks covers 2n horizontal scanning lines, wherein n is a positive integer. In step (b), an original polarity pattern which has positive polarities for n pixels in each column line of each polarity block and negative polarities for the other n pixels in each column line of each polarity block is generated. In step (c), a polarity inversion group having 2n polarity patterns which record polarity distributions obtained by rotating each row of the original polarity pattern under a DC balance requirement is obtained. In step (d), the polarity patterns are selected in the polarity inversion group for driving the pixels.

BRIEF DESCRIPTION OF THE DRAWINGS

The invention will be described according to the appended drawings in which:

FIGS. 5(*a*)–5(*e*) are diagrams for explaining the generating procedure of polarity blocks in accordance with the present invention;

FIGS. 6(*a*)–6(*d*) show polarity blocks of a polarity inversion group in accordance with the first embodiment of the present invention;

FIGS. 7(*a*)–7(*d*) show polarity blocks of a polarity inversion group in accordance with the second embodiment of the present invention; and FIGS. 8(*a*)–8(*f*) show polarity blocks of a polarity inversion group in accordance with the third embodiment of the present invention.

PREFERRED EMBODIMENT OF THE PRESENT INVENTION

Figure 1A:
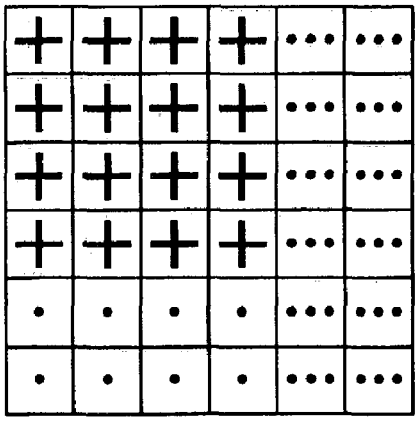
FIG. 1(a) (Background Art)
FIGS. 1(*a*)–1(*b*) show polarity patterns in accordance with a prior driving method employing a frame inversion.
Figure 1B:
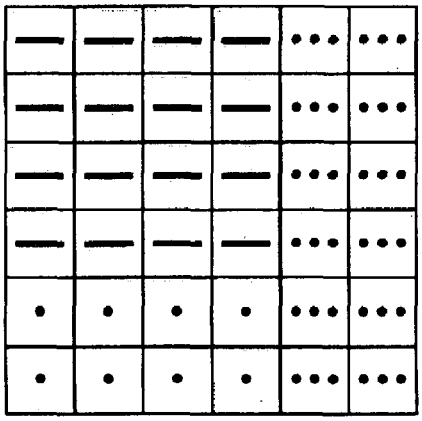
FIG. 1(b) (Background Art)
Figure 2A:
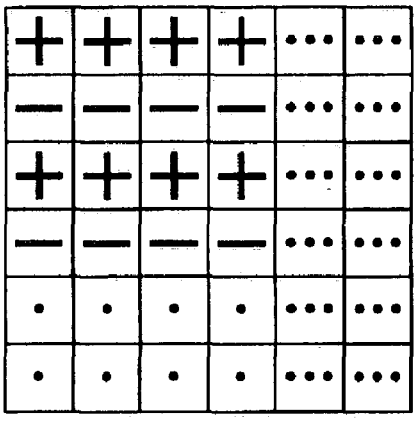
FIG. 2(a) (Background Art)
FIGS. 2(*a*)–2(*b*) shows polarity patterns in accordance with a prior driving method employing a row inversion.
Figure 2B:
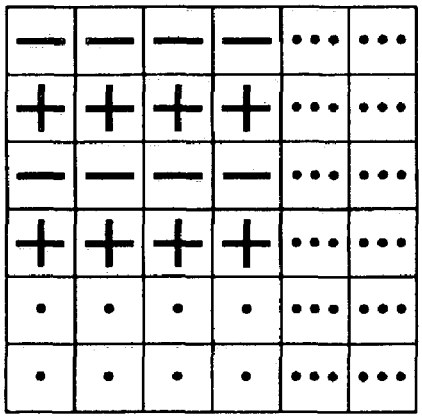
FIG. 2(b) (Background Art)
Figure 3A:
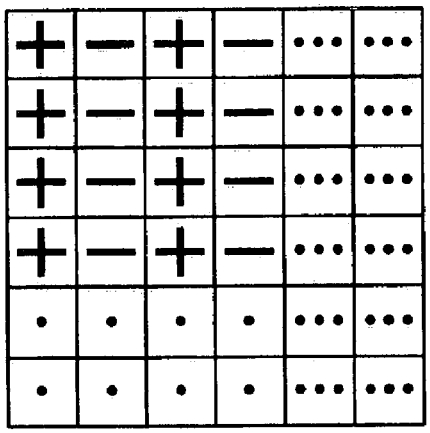
FIG. 3(a) (Background Art)
FIGS. 3(*a*)–3(*b*) show polarity patterns in accordance with a prior driving method employing a column inversion.
Figure 3B:
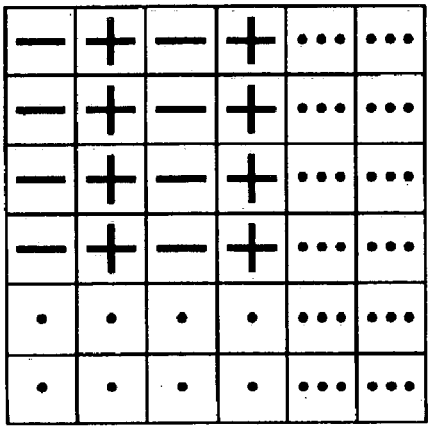
FIG. 3(b) (Background Art)
Figure 4A:
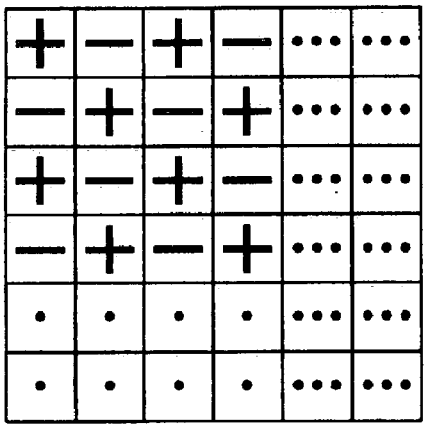
FIG. 4(a) (Background Art)
FIGS. 4(*a*)–4(*b*) show polarity patterns in accordance with a prior driving method employing a dot inversion.
Figure 4B:
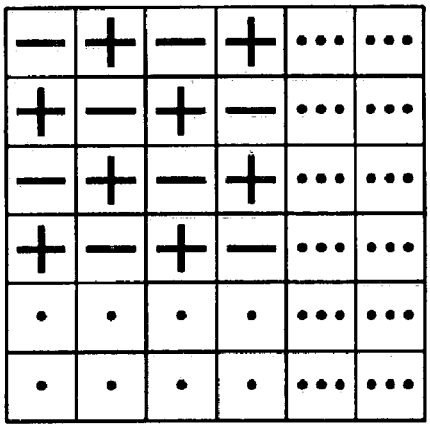
FIG. 4(b) (Background Art)

FIGS. 5(*a*)–5(*e*) are diagrams for explaining the generating procedure of polarity blocks in accordance with the present invention. First, a polarity frame is divided into a plurality of polarity blocks with the same area along the scanning lines, and each of the polarity blocks has the same even number of scanning lines. As shown in FIG. 5(*a*), the polarity block covers 2n pieces of scanning lines. For example, a XGA LCD panel fifteen inches in size has 768 scanning lines, wherein each scanning line is connected to 1,024 pixels. If n is equal to two, the XGA LCD panel is divided into 192 polarity blocks. Each polarity block covers four scanning lines. To simplify the driving circuit of an LCD panel, every polarity block in a polarity frame (or a polarity pattern) has the same polarity configuration. When n is equal to two, the driving method is called a 2-line mode dynamic inversion. If n is equal to three, the driving method is called a 3-line mode dynamic inversion. We explain these two modes in the following embodiments, and other modes are dependent on a similar generating procedure.

Referring to FIG. 5(*a*), in one column line of the polarity block, the polarities of one half of the pixels, total n, are positive, and the polarities of the other half of the pixels are negative. In comparison with FIG. 5(*a*), the polarity configuration of FIG. 5(*b*) is generated from sequentially shifting one polarity line to the next (or previous) polarity line and shifting the 2nth polarity line to the first polarity line. We can generate 2n polarity blocks by the same rotation rule that one polarity line is sequentially shifted to the next (or previous) polarity line and the 2nth polarity line is shifted to the first polarity line, such as FIG. 5(*c*), FIG. 5(*d*) and FIG. 5(*e*). We have the same polarity configuration as the FIG. 5(*a*) after the polarity configuration of FIG. 5(*e*) is changed by the rotation rule. Therefore, FIG. 5(*e*) shows the last of the polarity configurations in turn.

By a DC balance requirement as the prerequisite, we can obtain 2n polarity patterns from the aforementioned 2n polarity blocks, and each polarity pattern comprises one polarity block. Furthermore, the number of positive polarities and the number of negative polarities must to be equal on the same pixel of the 2n polarity patterns. The present invention can avoid image residue due to meeting the DC balance requirement. We can have a polarity inversion group as a combination of the 2n polarity patterns. The 2n polarity patterns are arranged in a sequence that is by generating order or by random order. Every polarity pattern appears one time during a period of the polarity inversion group. The polarity of each pixel is inverted from one polarity pattern to the next polarity pattern and from one period to the next period.

FIGS. 6(*a*)–6(*d*) show polarity blocks of a polarity inversion group in accordance with the first embodiment of the present invention. The first embodiment is a two-line mode, because n is equal to two. By the rotation rule of polarity lines, we can sequentially obtain four different polarity blocks. Each polarity block is for one polarity pattern. As shown in the first column (the leftest column) of FIG. 6(*a*), the polarities of the upper two pixels are positive, and the polarities of the lower two pixels are negative. Any two adjacent pixels in the same row have different polarities. The fourth polarity line is shifted to the first polarity line, and one of the other polarity lines is sequentially shifted to the previous polarity line. Therefore, the other three polarity blocks of FIGS. 6(*b*)–6(*d*) are sequentially obtained. The polarities of the pixel located in the first column and the first row are positive, positive, negative and negative respectively in each polarity block, so the DC balance requirement is satisfied. Other pixels also meet the DC balance requirement. A polarity inversion group is the combination of polarity patterns, each is composed of one of the polarity blocks in FIGS. 6(*a*)–6(*d*). During a period of the polarity inversion group, four polarity patterns sequentially appear on the LCD panel. The appearing sequence of the polarity patterns can be changed under the DC balance requirement, such as a sequence of FIG. 6(*a*), FIG. 6(*c*), FIG. 6(*b*) and FIG. 6(*d*).

The polarities of the pixels in one polarity line can be rearranged so as to obtain a different two-line mode dynamic inversion. The polarities of the pixels in the first polarity line are positive, positive, negative, negative . . . , as shown in FIG. 7(*a*). The other three polarity blocks of FIGS. 7(*b*)–7(*d*) are sequentially obtained by the rotation rule. A polarity inversion group is the combination of polarity patterns, each is composed of one of polarity blocks in FIGS. 7(*a*)–7(*d*). During a period of the polarity inversion group, four polarity patterns sequentially appear on the LCD panel. The appearing sequence of the polarity patterns can be changed under the DC balance requirement, such as a sequence of FIG. 7(*a*), FIG. 7(*c*), FIG. 7(*b*) and FIG. 7(*d*).

FIGS. 8(*a*)–8(*f*) show polarity blocks of a polarity inversion group in accordance with the third embodiment of the present invention. The second embodiment is a three-line mode, because n is equal to three. By the rotation rule of polarity lines, we can sequentially obtain six different polarity blocks. Each polarity block is for one polarity pattern. As shown in the first column (the far left column) of FIG. 8(*a*), the polarities of the upper three pixels are positive, and the polarities of the lower three pixels are negative. Any two adjacent pixels in the same row line have different polarities. The sixth polarity line is shifted to the first polarity line, and one of the other polarity lines is sequentially shifted to the previous polarity line. Therefore, the other five polarity blocks of FIGS. 8(*b*)–8(*f*) are sequentially obtained. The polarities of the pixel located in the first column and the first row are positive, positive, positive, negative, negative and negative respectively in each polarity block, so the DC balance requirement is satisfied. Other pixels also meet the DC balance requirement. A polarity inversion group is the combination of polarity patterns, and each is composed of one of the polarity blocks in FIGS. 8(*a*)–8(*f*). During a period of the polarity inversion group, six polarity patterns sequentially appear on the LCD panel. The appearing sequence of the polarity patterns can be changed under the DC balance requirement, such as a sequence of FIG. 8(*a*), FIG. 8(*c*), FIGS. 8(*e*), 8(*b*), 8(*d*) and FIG. 8(*f*). Furthermore, we can employ different polarity inversion groups, which all belong to the three-line mode, for different periods. Even though this driving method is complex, it doesn't depart from the scope of the present invention.

In additional, by the DC balance requirement as the prerequisite, we also can select a number of polarity patterns as a new polarity inversion group from the six polarity patterns, such as FIG. 8(*a*), FIG. 8(*b*), FIG. 8(*d*) and FIG. (*e*). The polarity patterns can be stored in memory or dynamically generated from a generator. In other words, a polarity frame is divided into a plurality of polarity blocks with the same area along scanning lines. Each polarity block has 2n horizontal scanning lines. The polarities of one half of pixels, total n, connected to the same signal line of one polarity block are positive, and the polarities of other half of pixels are negative. So a first polarity block is generated. We sequentially rotate x, less than 2n, cycles by the rotation rule, then can obtain x polarity patterns. If the x polarity patterns also meet the DC balance requirement, a polarity inversion group can be composed of the x polarity.

On the contrary, the prior art of Taiwan Patent No. 401,529 only provided four polarity patterns, and cannot have a polarity inversion group comprising more than four polarity patterns as the present invention does. The driving method of the present invention is compatible with a conventional driving circuit. However, the prior art needs to have more signal driving devices in a driving circuit to achieve its goal. Therefore, the present invention is superior to the prior art in manufacturing costs and compatibility.

The above-described embodiments of the present invention are intended to be illustrative only. Numerous alternative embodiments may be devised by persons skilled in the art without departing from the scope of the following claims.

What is claimed is:

1. A method for driving an LCD in a dynamic inversion manner, comprising the steps of:

dividing a full frame into a plurality of polarity blocks, each of the polarity blocks covering 2n horizontal scanning lines, wherein n is a positive integer;

generating an original polarity inversion pattern which has positive polarities for n pixels in each column line of each polarity block and negative polarities for the other n pixels in each column line of each polarity block;

generating a polarity inversion group having 2n polarity patterns which respectively record polarity distributions obtained by sequentially rotating each row of each of the polarity blocks of the original polarity pattern under a DC balance requirement; and selecting the 2n polarity patterns or a plurality of polarity patterns from the polarity inversion group for driving the pixels of the full frame.

2. The method for driving an LCD in a dynamic inversion manner of claim 1, wherein each polarity pattern in the polarity inversion group is obtained by sequentially rotating up each row of each of the polarity blocks of the original polarity pattern by one row.

3. The method for driving an LCD in a dynamic inversion manner of claim 1, wherein each polarity pattern in the polarity inversion group is obtained by sequentially rotating down each row of each of the polarity blocks of the original polarity pattern by one row.

4. The method for driving an LCD in a dynamic inversion manner of claim 1, wherein the 2n polarity patterns or the plurality of polarity patterns from the polarity inversion group for driving the pixels are selected randomly.

5. The method for driving an LCD in a dynamic inversion manner of claim 1, wherein each of the polarity patterns for driving the pixels of the full frame appears once in one cycle.

6. A method for driving an LCD in a dynamic inversion manner, comprising the steps of:

dividing a full frame into a plurality of polarity blocks, each of the polarity blocks covering 2n horizontal scanning lines, wherein n is a positive integer;

generating an original polarity pattern which has positive polarities for n pixels in each column line of each polarity block and negative polarities for the other n pixels in each column line of each polarity block;

generating a polarity pattern which records a polarity distribution obtained by rotating x rows of each of the polarity blocks of the original polarity pattern under a DC balance requirement, wherein x is a positive integer and not larger than 2n; and selecting the polarity pattern for driving the pixels of the full frame.

7. The method for driving an LCD in a dynamic inversion manner of claim 6, wherein the polarity pattern for driving the pixels is obtained by rotating up each row of each of the polarity blocks of the original polarity pattern by one row.

8. The method for driving an LCD in a dynamic inversion manner of claim 6, wherein the polarity pattern for driving the pixels is obtained by rotating down each row of each of the polarity blocks of the original polarity pattern by one row.

9. The method for driving an LCD in a dynamic inversion manner of claim 6, wherein the polarity pattern for driving the pixels is selected randomly.

10. The method for driving an LCD in a dynamic inversion manner of claim 1, wherein the plurality of polarity patterns from the polarity inversion group for driving the pixels of the full frame are selected under a DC balance requirement.

* * * * *